United States Patent [19]

Caporusso et al.

[11] Patent Number: 4,532,787

[45] Date of Patent: Aug. 6, 1985

[54] PORTABLE ELECTROMECHANICALLY-CONTROLLED PIPE-BENDING APPARATUS

[75] Inventors: Alessandro Caporusso; Mario Caporusso, both of Frosinone, Italy

[73] Assignee: C.M.L. Costruzioni Meccaniche Liri S.r.l., Frosinone, Italy

[21] Appl. No.: 356,366

[22] Filed: Mar. 9, 1982

[30] Foreign Application Priority Data

| | | | |
|---|---|---|---|
| Mar. 16, 1981 | [IT] | Italy | 48029 A/81 |
| Nov. 12, 1981 | [IT] | Italy | 49701 A/81 |
| Feb. 8, 1982 | [IT] | Italy | 47749 A/82 |

[51] Int. Cl.[3] ..... B21D 7/04

[52] U.S. Cl. ..... 72/158; 72/149

[58] Field of Search ..... 72/149, 155, 158, 159, 72/157

[56] References Cited

U.S. PATENT DOCUMENTS

| | | | |
|---|---|---|---|
| 2,466,381 | 4/1949 | Clouse | 72/158 |
| 2,754,879 | 7/1956 | Gautier | 72/158 |
| 2,762,415 | 9/1956 | Franck | 72/158 |
| 2,955,638 | 10/1960 | Hellwig | 72/158 |
| 3,236,082 | 2/1966 | Beck et al. | 72/149 |
| 3,260,091 | 7/1966 | Shaw, Jr. | 72/157 |
| 3,921,424 | 11/1975 | Pearson | 72/158 |
| 3,949,584 | 4/1976 | Pearson et al. | 72/149 |

*Primary Examiner*—Daniel C. Crane

*Attorney, Agent, or Firm*—Young & Thompson

[57] ABSTRACT

A portable pipe-bending apparatus is electromechanically controlled to bend a pipe up to an angle of 180° without providing any undesirable uneven stretching, also when the pipe is formed of a material which is particularly sensitive to stretching stresses. A driving motor-reducer is used which comprises a motor of low power and very high speed and a reduction gear with a very high reduction so as to rotate a semipulley main bending member, or matrix, having a peripheral semicircular groove. A second bending member, or countermatrix, faces the matrix and is supported by a supporting member which may be moved away or approached to the matrix at a distance in accordance with the diameter of the pipe to be bent. The countermatrix has a particularly shaped groove which provides an elastic ovalized deformation of the cross section of the pipe and thereby a reserve of resistance to the stretching stresses during a bending operation, so as to avoid any failure, or wrinkle lines, or flattening of the bent pipe, the original circular cross section of same being thereby easily and quickly recovered. A wider range of pipe diameters as well as smaller thickness in respect to prior art may then be bent without using any core. An auxiliary pipe supporting member is used to co-operate with the matrix and countermatrix, such auxiliary supporting member having a linear concave groove in accordance with the pipe diameter to be bent.

6 Claims, 16 Drawing Figures

118
c
t
113
114
117
118'
126
125
118b
124
90
115
119
12
12
129
133
0
0
180
132
120
a
110
115
118a
b
b'
111
123
142
122'
122
121
138
137
139
116
t'

119'
110
118
d
c
t
113
114
117
118'
111
115
11
119
133
129
132
126
e
11
115
119'
d
138
137
t'
121
122
122'
123
123'

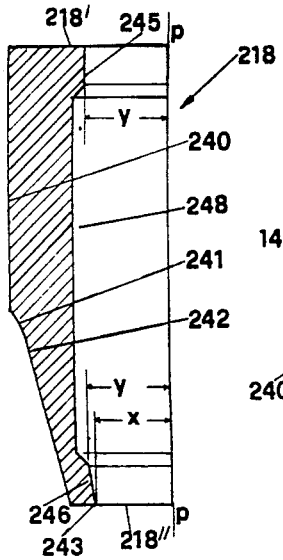
FIG.14
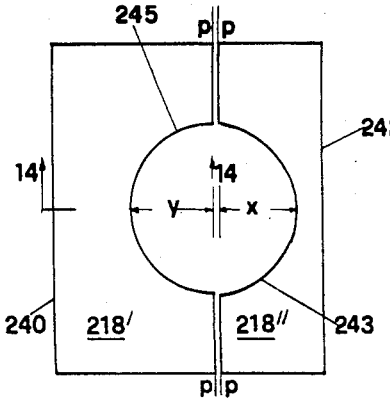
FIG.15
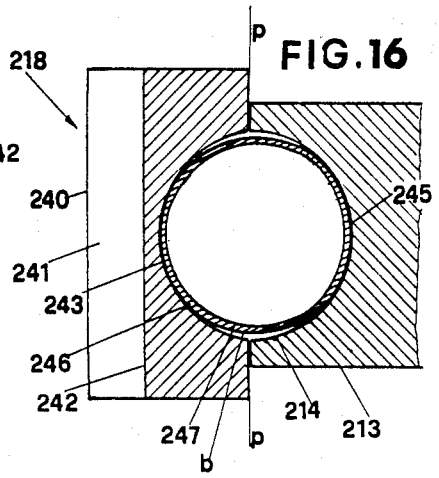
FIG.16
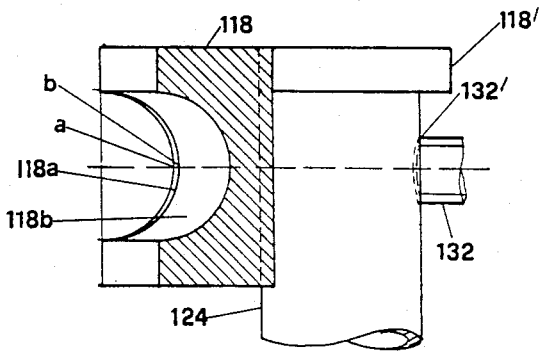
FIG.12
FIG.11
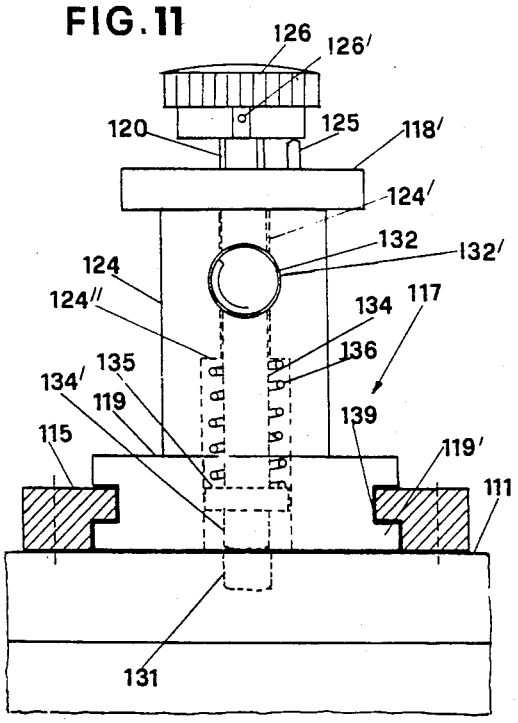
FIG.13
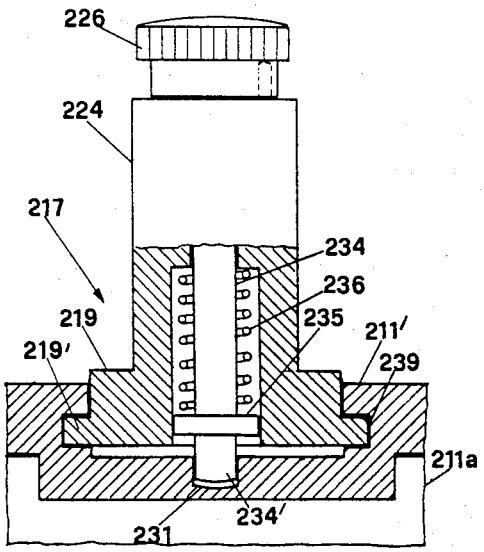

PORTABLE ELECTROMECHANICALLY-CONTROLLED PIPE-BENDING APPARATUS

BACKGROUND OF THE INVENTION

Apparatus for pipe-bending, both in new plant or to repair serviceable plants wherein pipes are used for fluid flow—for example for hot and/or cold water for sanitary and/or heating fittings—call usually for requirements regarding the practical use of same, particularly when the bending operation is to be carried out at the site of the plant and when pipes having a wide range of diameters and small thickness (less than 1 mm) are to be bent by means of a single bending apparatus.

Attempts have been made to produce portable pipe bending apparatus to be used on site, the features of which considerably reduce the overall dimensions and make easier the bending operation. In spite of these attempts, the bending apparatus of the prior art is not fully satisfactory in its constructive and operative purposes, also because the pipe bending operation being carried out by same does not avoid any undesirable uneven stretching of the pipe which might even be evidenced at a subsequent time. Failures and/or wrinkle lines may be formed on the pipe during a bending operation when the material is sensitive to stretching stresses and a flattening may also be remarked on the bent pipe. These undesirable uneven stretching effects are, for example, much more probable when pipes of hard copper are to be bent and the portable pipe bending apparatus requires the best attention of the operator during the bending operation, which in any case cannot be carried out rapidly by means of bending apparatus of the prior art which is usually controlled manually.

On the other hand, the increasing installation of systems for heating and sanitation, particularly for cold and hot water flow, as well as the increasing use of pipes formed of materials sensitive to stretching stresses, increases the importance not only of a speedy and actually satisfactory bending operation and an easy installation, but also of an economical pipe-bending construction and production and the pipe installation costs.

By using the pipe bending apparatus in accordance with the present invention, the bending operation is in any case speedy and some embodiment of the same are possible in order to be suitable to the features of the pipe to be bent.

SUMMARY OF THE INVENTION

The main object of the present invention is to provide an electrochemically-controlled pipe-bending apparatus of a portable type to operate under the best conditions of transport, transition, operative speed to bend a pipe up to an angle of 180° without providing any undesirable uneven stretching, also when the pipe to be bent is formed of a material which is particularly sensitive to stretching stresses. The portable structure of the pipe bending apparatus with the operative and control members contained therein has a relatively modest weight and may be placed on any suitable support, only a normal socket being necessary to supply electric current to a driving motor-reducer so that the main concave grooved member of the bending apparatus may be rotated.

Moreover, the present invention aims to provide an electrochemical control of the main concave grooved member of the bending apparatus by means of a motor speed reducer, not only to speedily carry out a bending operation, but also to operate with an actually suitable rotary speed of such controlled main grooved member by using a very high speed motor and a corresponding very high reducer in order to rotate the main bending member with a number of revolutions which is actually suitable for the best effects on the bent pipe.

Another object of the present invention is to provide such rotary main grooved member as well as the facing bending member so that a pipe is held therebetween at the start of a bending operation and then progressively advanced automatically with the co-operation of an auxiliary pipe supporting member, in order that the pipe may be bent up to a desired angle, even 180°.

A further object of the present invention is to provide such facing bending member of the main rotary member of the aparatus with a groove shape which is not only suitable to hold and advance a pipe to be bent, but also to bend pipes formed of a material particularly sensitive to the stretching stresses that are imposed thereon during the bending operation.

Another object of the present invention is to provide such rotary concave grooved member as well as the facing concave grooved member as interchangeable pieces, so that they may be suitable for bending pipes of different diameters.

BRIEF DESCRIPTION OF THE DRAWINGS

From the above, those skilled in the art may already deduce that this new electrochemically-controlled pipe-bending apparatus of the portable type is an improvement compared to the prior art and many advantages are possible through its use.

Some embodiments of the invention will now be described, by way of examples, with reference to the accompanying drawings in which:

FIG. 11 is on a larger scale a sectional view taken on the line 11—11 of FIG. 7.

FIG. 12 is on a larger scale a sectional view taken on the line 12—12 of FIG. 5.

FIG. 13 is on a larger scale a sectional view taken on the line 13—13 of FIG. 8.

FIG. 14 is a sectional view taken on the line 14—14 of FIG. 15.

FIG. 15 is on a larger scale a schematic view of the top and bottom surfaces of the facing bending member in accordance with this third example of embodiment as shown in FIG. 8, such surfaces being arranged in a specularly opposite position.

FIG. 16 is on a larger scale a sectional view of the co-operating bending members with the pipe inserted therebetween, taken on the lines 16—16 of FIG. 8.

DETAILED DESCRIPTION OF THE EMBODIMENTS

Figure 8:
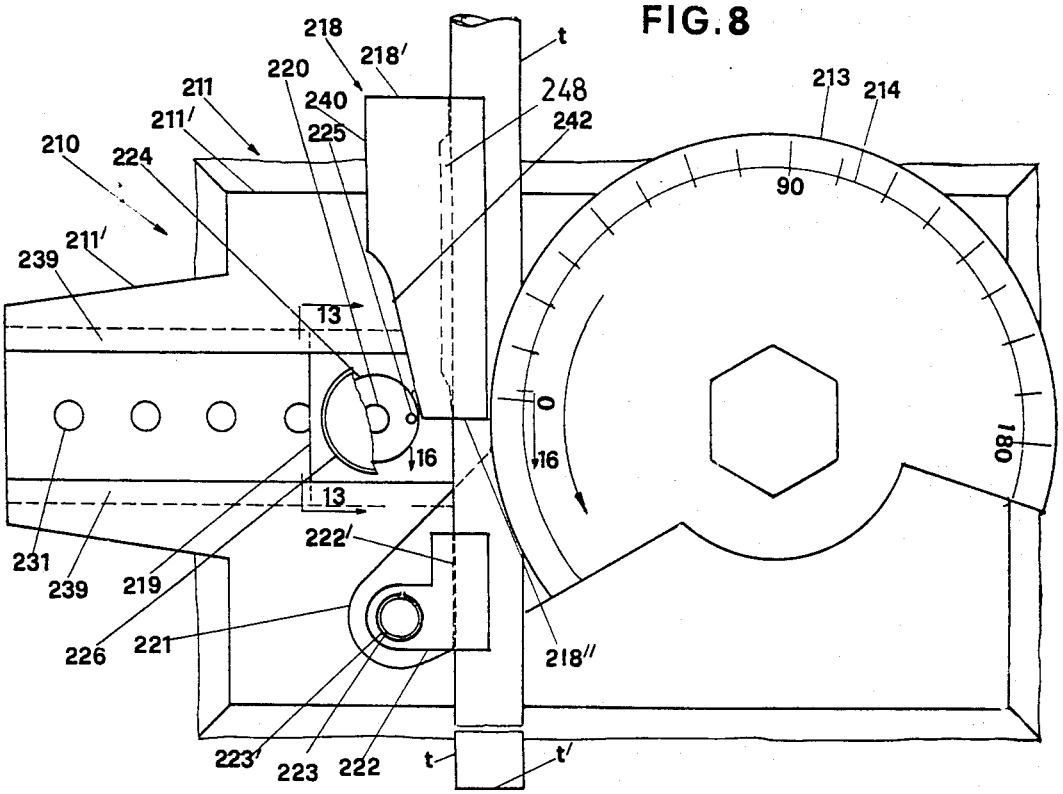
FIG. 8 is a schematic top view of a pipe bending apparatus in accordance with a third example of embodiment of the present invention, wherein the positions of the bending members and pipe are shown at the start of a bending operation.

Before describing these embodiments of the invention it is important to note that in any case the electrochemically-controlled pipe-bending apparatus of the portable type in accordance with the present invention generally appears as in FIG. 8 (wherein it has been indicated by the reference numeral 210) and comprises three main parts, namely: a main body (211) in the form of a box containing a driving motor-reducer (not shown) to rotate the main bending member of the apparatus; a main bending member (213) in the form of a semipulley having a semicircular groove (214) hereinafter called a "matrix"; and a facing grooved member (218) having a particularly shaped groove which is hereafter called a "countermatrix", such a particularly shaped groove of the countermatrix being so positioned in respect to the semicircular groove of the main bending member or matrix (213) that a pipe to be bent may be held therebetween and bent by a bending operation.

Moreover, the modifications between the examples of embodiment of the invention, which will be hereafter described, principally concern the constructive and operative features of the countermatrix. The matrix and countermatrix are in any case provided as interchangeable pieces to be suitable for bending pipes of different diameter.

Turning now to FIGS. 1 to 4, there is illustrated a first example of embodiment of the invention. The pipe bending apparatus (see FIGS. 1 and 2) which is generally indicated with the reference numeral 10, has a main body 11 formed as a parallelepiped box therein a driving motor-reducer is mounted (not shown) which while being of a conventional type has some important features as specified hereafter. This driving motor-reducer is used to rotate a semicircular grooved semipulley 13, i.e. the matrix 13 of pipe-bending apparatus 10. Matrix 13 is fastened on the driving shaft section 12 which protrudes from box 11 by means of a key 12', so that the rotary speed of such matrix is that of the driving motor-reducer shaft.

At this point it may be important to recall that, while a conventional driving motor-reducer is used in accordance with the present invention, some particular features of the same are to be pointed out in the light of practical experiments of the Applicant. A motor of 450 W is suggested with a speed of about 25,000 to 26,000 r.p.m. Through a reduction gearing that speed of the motor is reduced, so that the protruding shaft 12 rotates at about 5 to 7 r.p.m. In accordance with FIGS. 1 to 4 a counterclockwise rotary motion of matrix 13 is provided for a pipe bending apparatus, but a reverse rotation is also possible and the operator may act on a suitable lever 27 to control the rotating motion of matrix 13.

Coming back again to the pipe-bending members of apparatus 10 shown in FIGS. 1 to 4, it may be seen that a countermatrix 16 having a semicircular groove 16' as well as a linear pipe supporting member 22 having a semicircular groove 22' are provided, the semicircular grooves 16' and 22' being like semicircular groove 14 of matrix 13, the diameter of which is that of the pipe to be bent. It is however possible to use a countermatrix and linear supporting member of the pipe the grooves of which are of universal type, i.e. suitable to co-operate with any matrix the semicircular groove the diameter of which is that of the pipe to be bent, obviously within the limits of the portable bending apparatus 10 being used. In this case the matrix only will be an interchangeable piece of the apparatus.

An important feature of countermatrix 16 concerns its easy handling. As shown in FIGS. 1 to 4, countermatrix 16 is of a pulley type and is freely rotatable about a vertical tubular pin 18 the bottom end of which is fastened to one end of a base plate 19, the other end being in its turn rotatable about a vertical pin 20 which is fastened to the protruding section 11' of box 11. Moreover, a pin 18' is provided which is slidable within such tubular pin 18 and pushed downwards by a conventional spring means so that its pointed bottom end is usually protruding from the lower surface of base plate 19 but may however be drawn up by the operator by acting on the top handle 17 of same.

Figure 4:
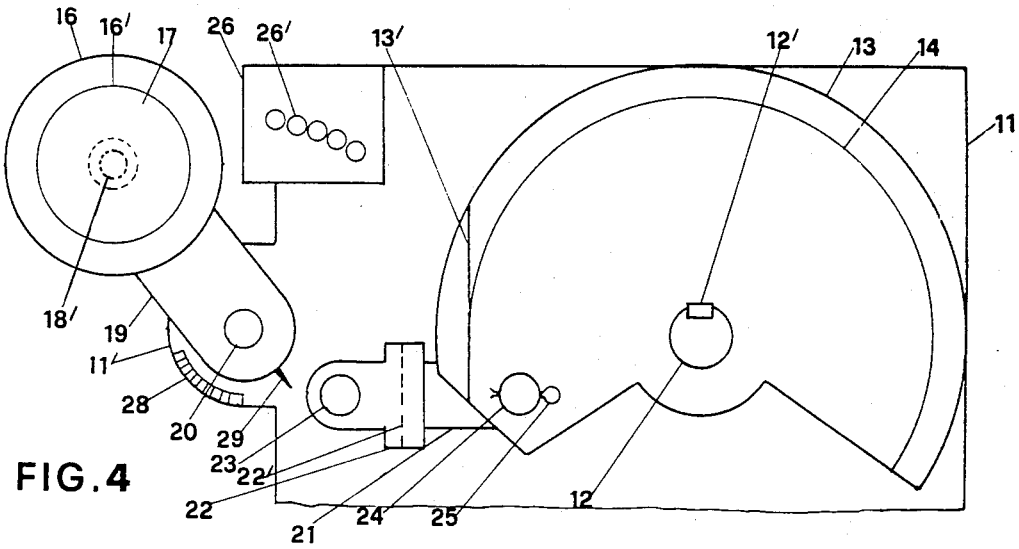
FIG. 4 is a schematic top view in accordance with such first embodiment of the present invention wherein the bending members are shown before a pipe to be bent is rightly positioned for a bending operation.

In order that the unit 16–19 may be rotated freely it is necessary to draw up the pin 18'. Countermatrix 16 and base plate 19 are then rotated from an original position as shown in FIG. 4 to a position suitable for a bending operation, as a plate 26 having holes arranged along an arcuate line allows one to fasten unit 16–19 by inserting such pointed end of pin 18' into one of holes 26' which corresponds with the diameter of the pipe to be bent. Such position is indicated on a scale 29 by a hand 28. By a reverse rotating motion of unit 16–19 the bent pipe may then be released.

It should also be noted that a partial cutting 13' of the upper surface of matrix 13, namely up to the bottom of groove 14 may be useful to make easier the operations of inserting the pipe between the matrix and countermatrix or removing the same therefrom.

Moreover, it should be pointed out that in accordance with this first example of embodiment base plate 21 of linear pipe supporting member 22 has been assumed as having two fixed pins 23 and 24 at the opposite ends thereof, so that such base plate 21 freely rotates into a hole of matrix 13 wherein it is held by cotter pin 25, while the pipe supporting member 22 freely rotates about pin 23.

Figure 1:
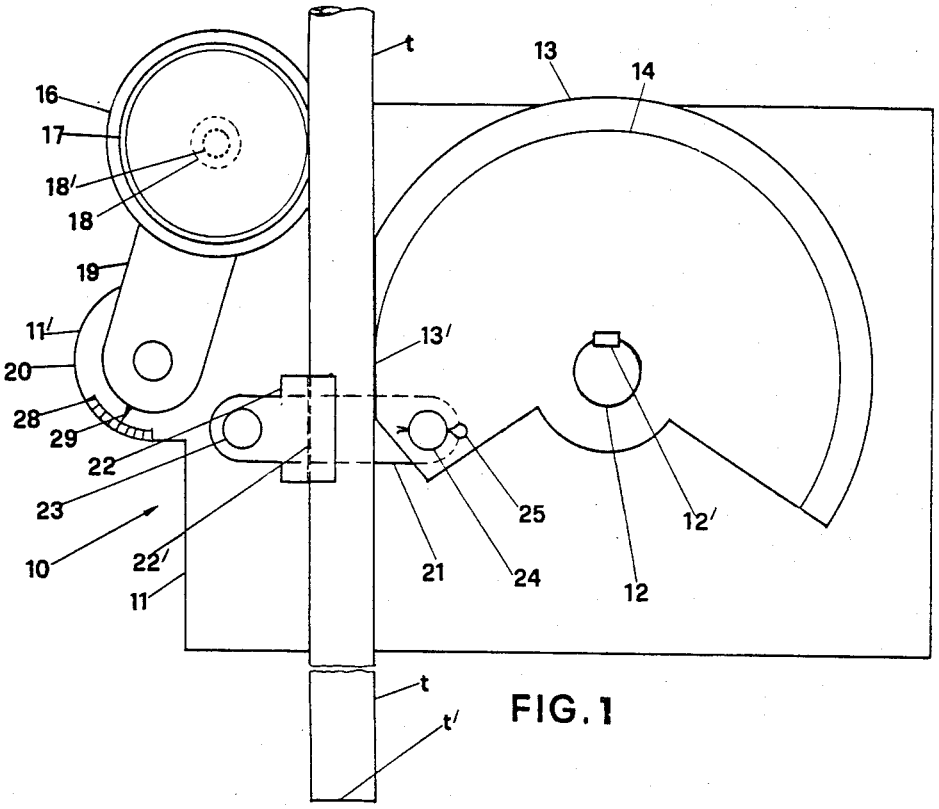
FIG. 1 is a schematic top view of a portable pipe bending apparatus in accordance with the present invention, wherein the positions of the bending members and pipe are shown at the starting of a bending operation.
Figure 3:
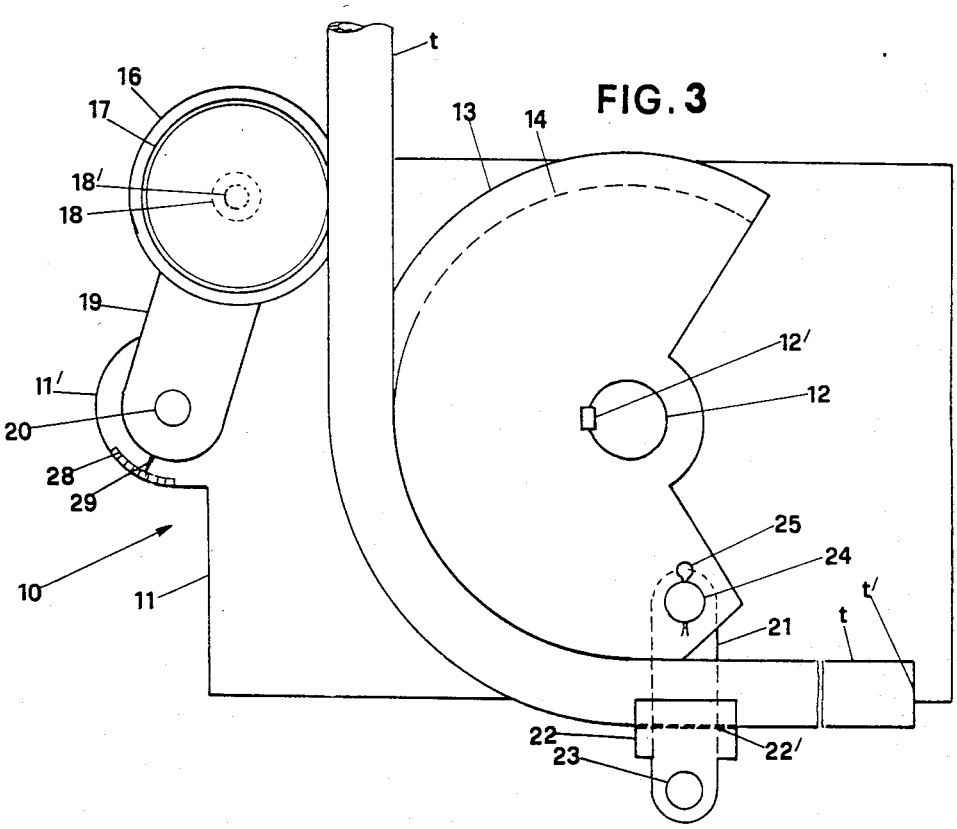
FIG. 3 is a schematic top view like FIG. 1 wherein the bending members and the pipe are however shown after a partial or total bending of a pipe has been carried out.
Figure 2:
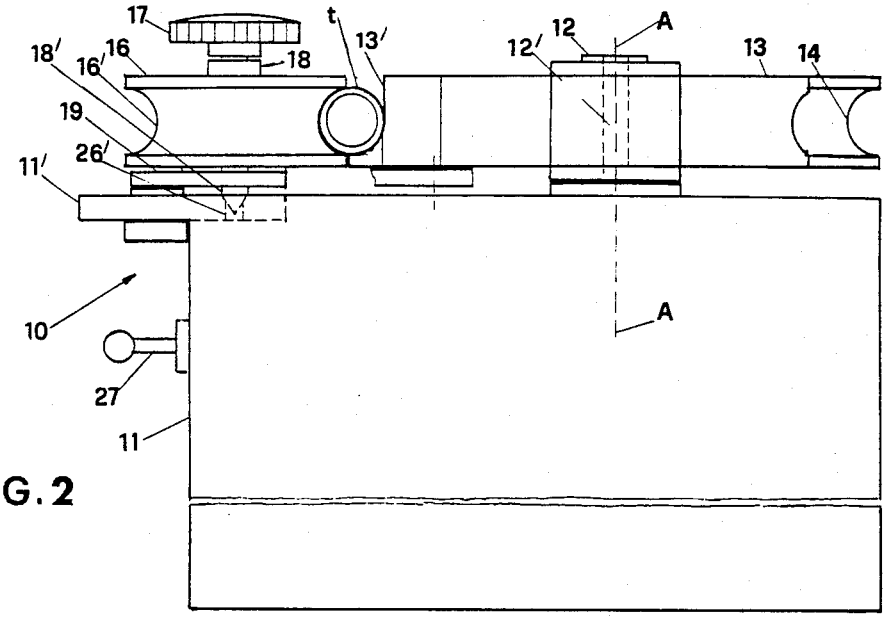
FIG. 2 is a schematic partially removed elevation view from the output side of the pipe to be bent, in accordance with FIG. 1.

At the start of a bending operation by using this first embodiment of pipe-bending apparatus 10 in accordance with the invention, the terminal section of pipe t from which the bending is to be started is placed between the matrix and countermatrix and the pipe supporting member 22 is positioned so that pipe t may be actually held therebetween. After the driving motor-reducer is started, the bending operation is also started and then continued by the rotary motion of matrix 13 and the co-operating friction produced between the outer surface of pipe t and grooves 16' and 22' of countermatrix 16 and linear supporting member 22, respectively. Such a friction causes the clockwise rotation of countermatrix 16 about its tubular pin 18 as well as a like rotation of base plate 21 of pipe supporting member 22 about its pin 24, the position of this latter depending on that of matrix 13, for example as shown in FIG. 3 after a counterclockwise rotation angle of 90° of matrix 13.

When the desired bending of the pipe is accomplished, it is sufficient to reverse the rotation of countermatrix base plate 19 and matrix 13 to release and remove the bent pipe. The bending operation of a next pipe may then be started and continued as described above.

Referring now to a second example of embodiment illustrated in FIGS. 5 to 7 and 11, those skilled in the art may easily note that the most important modifications in respect to the described and illustrated first embodiment of FIGS. 1 to 4 are substantially: (1) the supporting member of the countermatrix; (2) the countermatrix with a particularly shaped groove; (3) means to position such countermatrix at the right distance from the matrix to held the pipe to be bent therebetween; (4) the scale on the matrix to better define the bending angle of a pipe; (5) the connection of the pipe supporting member with the matrix.

Figure 6:
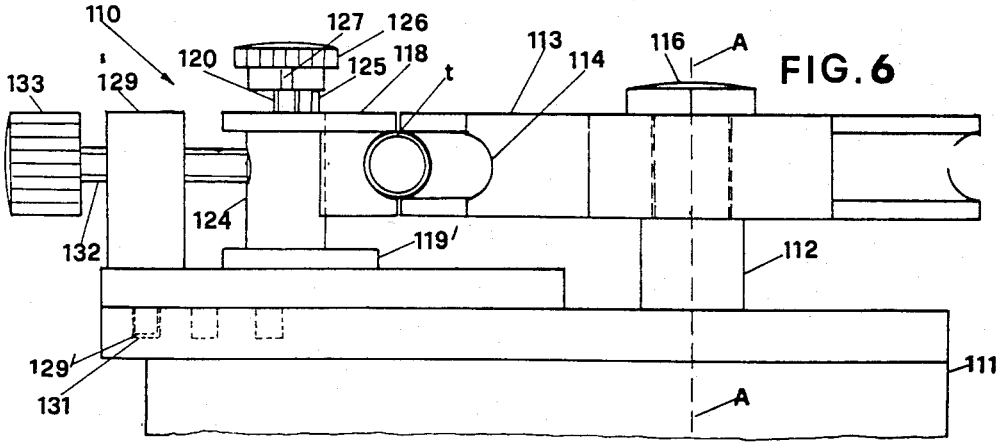
FIG. 6 is a schematic partially removed elevation view from the output side of the pipe to be bent, in accordance with FIG. 5.
Figure 5:
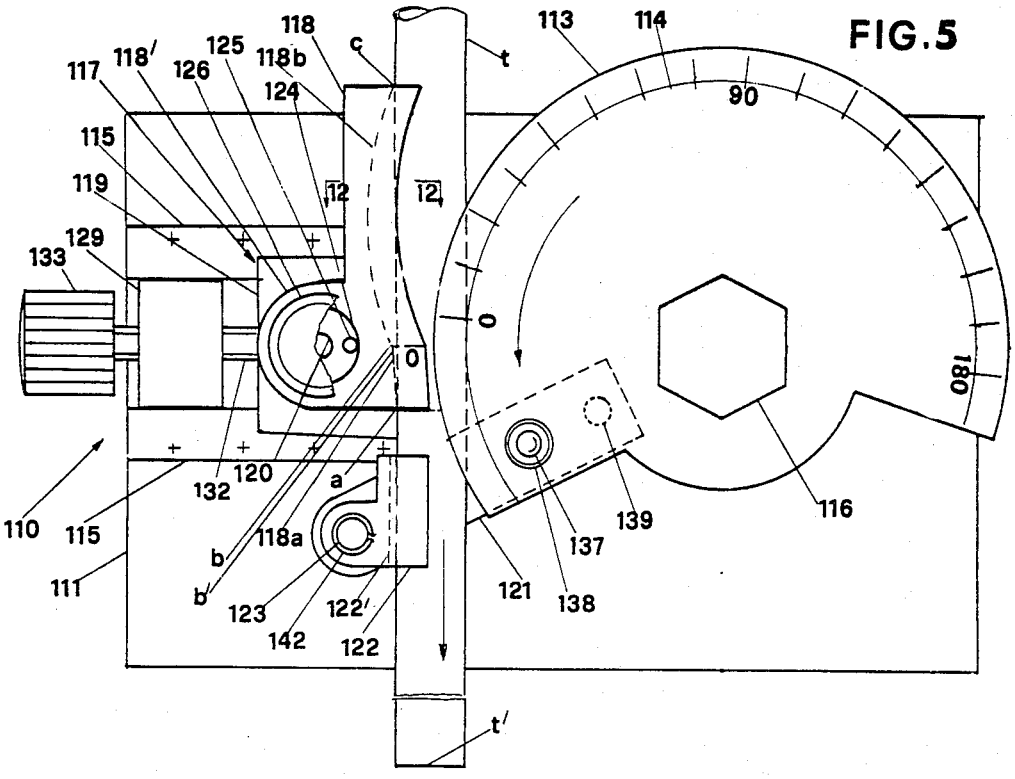
FIG. 5 is a schematic top view of a pipe bending apparatus in accordance with a second example of embodiment of the present invention, wherein the positions of the bending members and pipe are shown at the start of a bending operation.
Figure 7:
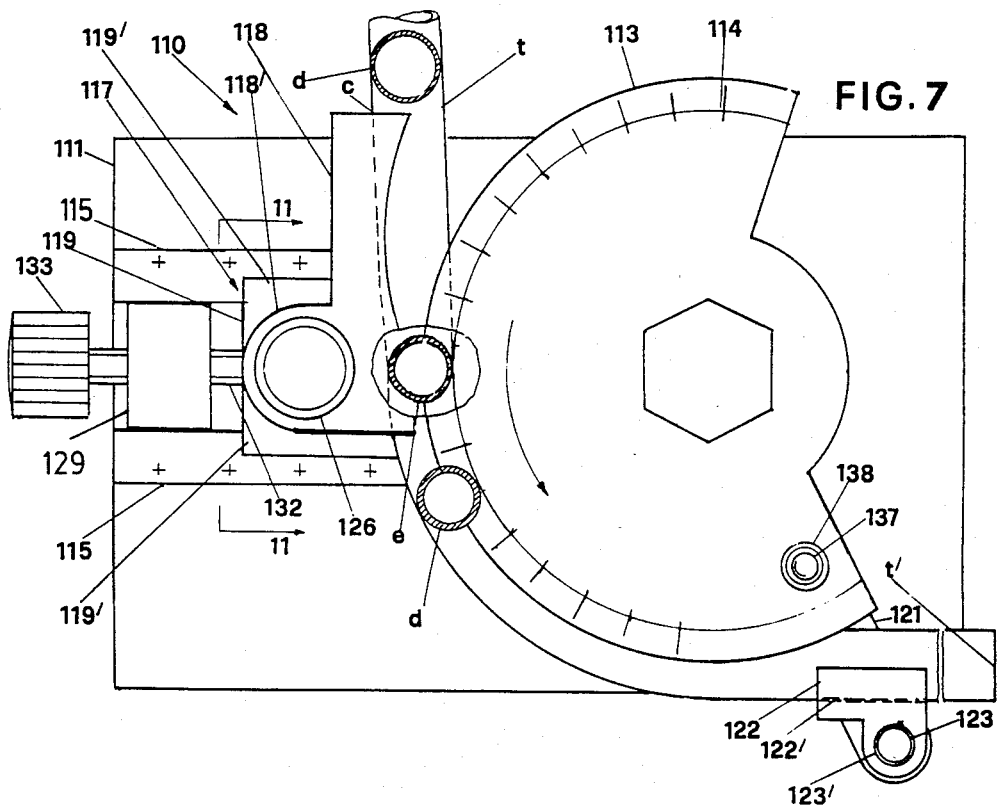
FIG. 7 is a schematic top view like FIG. 5 wherein the bending members and pipe are however shown after a partial or total bending of the pipe has been carried out.

In FIGS. 5 to 7 the most important bending members which are like those of FIGS. 1 to 4 are indicated with like reference numerals with addition of 100.

Before explaining the important innovative features of the particularly shaped groove of the modified countermatrix 118 in accordance with this second example of embodiment, it is desirable to specify the constructive features of a provided supporting member of the countermatrix as well as the solution proposed and tested for moving away or approaching the same in respect to the matrix, in order to hold a pipe therebetween when a bending operation is to be carried out. In accordance with this second example of embodiment, the modified supporting member of the countermatrix gives the possibility of using not only such modified countermatrix, but also the countermatrix of pulley type 16 described and illustrated in the first example of embodiment.

Turning now to FIGS. 5 to 7 and 11, a vertical cylindrical supporting member 124 is provided for the countermatrix which is solid with a base plate 119 as a unit indicated with the rerence numeral 117. The opposite parallel edges 119' of base plate 119 in a radial direction of matrix 113 are shaped so that may be connected with corresponding protrusions of parallel guides 115 of inverted L shape. Such guides 115 are fastened on the cover of box 111 of the apparatus, and the protrusions of the same are specularly opposite inwards and inserted into corresponding grooves 139 of base plate 119. The unit 117 may in this manner be slid along guides 115 so that the countermatrix mounted on its supporting member 124 may in its turn approach matrix 113 until the pipe to be bent is held therebetween.

In order that unit 117 may be used for both countermatrix 118 and 16, its vertical cylindrical support member 124 is provided with a coaxial hole 124' wherein a pin 134 is slidable. Hole 124' is enlarged to its lower section and a shoulder 124' is thereby formed, while slidable pin 134 is in its turn provided with a flange 135 below which is its bottom end 134'. As between shoulder 124'' and upper surface of flange 135 a spiral pressure spring 136 is provided, pin 134 is usually pushed downwards so that its bottom end 134' protrudes from the bottom surface of base plate 119 and may then enter one of the holes 131 provided on the cover of box 11. Holes 131 are arranged along the middle line between parallel guides 115 and it is thus possible to fasten unit 117 in a position which is suitable to support a pulley countermatrix—e.g. countermatrix 16—for a bending operation, when bottom end 134' of pin 134 enters a corresponding hole 131.

When a countermatrix 118 in accordance with this second embodiment is to be used, unit 117 is to be freely slidable between guides 115 and for this purpose it is sufficient that the operator draws up the handle 126 provided at the top end 120 of pin 134, in order that the bottom surface of the same rests on a vertical pin 125 after being rotated suitably. In this manner bottom end 134' of slidable pin 134 is withdrawn from its usual protruding position, as shown in FIG. 11 and the released unit 117 may then be slid as desired.

The sliding motion for holding a pipe to be bent between matrix 113 and countermatrix 118 is carried out through an auxiliary member 129 between guides 115 and fastened in a preferred position by inserting its pin 129 which protrudes downwards into one of holes 131. Such member 129 is provided with a threaded hole to be used for screwing therein a threaded pin 132 by means of a handle 133 in order that the free end of threaded pin 132 may act on a notch 132' of the peripheral surface of supporting member 124. Countermatrix 118 thereby approaches to the pipe to be bent and holds this latter between the matrix and countermatrix in accordance with the present invention.

Further in relation to the pipe supporting member 122 of this second embodiment of the invention it should be pointed out that a single pipe supporting member 122 with base plate 121 could be used in connection with any matrix 113 for bending pipes of different diameters, the connection being performed by means of a pin 139 and a bolt 137 with nut 138. That is to say, a single base plate 121 with pin 123 and pipe supporting member 122 with a universal groove may be transferred from one to another matrix 113 suitable for bending pipes of different diameter.

The special function of countermatrix 118 substantially depends on the shape of its groove, which in accordance with this second embodiment of the invention is actually formed with two sections **118*a* and 118*b* as shown in FIG. 5. The first section on the output side of the pipe to be bent is short and rectilinear and extends from point a to point b, while the next section 118*b* is long and arcuate with a radius greater than the bending radius of matrix 113 and its extension is from point b to point c. Because of the very small inclination of section 118*a* in respect to the line a-c, when a pipe t is placed between matrix 113 and countermatrix 118 the starting contact between countermatrix 118 and pipe t occurs only at the opposite points a and c of the countermatrix 118, that is to say, the intermediate point b does not come into contact with pipe t as it is slightly re-entrant, for example about some tenths of one millimeter. Moreover, the rectilinear form of pipe t along the direction of its advancement is maintained and not impaired by the pipe supporting member 122, as this member is still rotating about its pin 123 and its groove 122' does not come into contact with pipe t to be bent. As shown in FIG. 5, in this condition the point O of the matrix scale—which indicates the actual start of the pipe bending—is not yet in registry with the facing O marked on countermatrix 118**.

When the rotation of matrix 113 is started, the contact of countermatrix 118 with pipe t will continue at point c, while the contact of the pipe at point a of the countermatrix will be progressively extended along the rectilinear section 118*a*. An autoalignment is thereby obtained when the pipe bending is just started and a regular distribution of the stretching stresses of the pipe is consequently provided by the bending operation. Because of the particularly shaped groove of countermatrix 118 the originally circular cross section d of pipe t assumes a deformed oval shape e, however within the elastic limit of pipe t, so that the originally circular cross section d is easily and quickly recovered, when the pipe is released from the action of the countermatrix.

During as well as after a desired bending operation no failure and/or wrinkle line as well as flattening are thus noted on the bent pipe, the outer surface of which appears again smooth, even when pipes of large diameter and/or small thickness are bent and the pipe material as well as the pipe produced from the same is sensitive to stretching stresses.

A third example of embodiment of the present invention is illustrated in FIGS. 8 to 10 and 13 to 16 and described hereafter with the introductory statement that in this case some provided modifications are: (1) the constructive and operative features of the countermatrix; (2) means to position such countermatrix at the right distance from the matrix to hold therebetween the pipe to be bent; (3) the connection of the pipe supporting member with the matrix, so that in FIGS. 8 to 10 and 13 to 16 like elements in respect to FIGS. 1 to 4 are indicated with like reference numerals with the addition of 200, while like elements in respect to FIGS. 5 to 7 are indicated with like reference numerals with the addition of 100.

Turning now to FIGS. 8 to 10 and 13 to 16 it may be seen that the unit 217 which is generally like unit 117 of the second embodiment, has only a little difference from this latter. The base plate 219 is in this case shaped as a reversed L, the protruding opposite parallel edges 119' of which are inserted into grooves 239 of the box cover. Such grooves 239 are actually provided in a protruding section 211' of the cover of box 211 forming with the same a single body. On the other hand, box 211 is formed with two superimposed sections 211*a* and 211*b*, the four sides of this latter being gradually enlarged in order that a larger supporting surface is formed at the bottom of the box.

As shown in FIG. 13, in comparison with FIG. 11, the vertical cylindrical support 224 is substantially like cylindrical support 124 of the second embodiment and slidable along guides 239 up to the operative position of same in accordance with the diameter of the pipe to be bent. In this connection it should be pointed out that a modified countermatrix is provided which is indicated with the reference numeral 218. This countermatrix 218 is to be interposed manually between cylindrical support 224 and pipe t at the start of a bending operation. It will be easily understood that, while this pipe-bending apparatus is of a portable type it is possible to bend a wide range of pipe diameters, in any case greater than in the prior art, for example from 4 mm to about 35 mm, without using for the same any core as, on the contrary, is required to bend such pipes in accordance with the prior art, particularly for bending pipes of large diameter—even about 35 mm—and small thickness.

The innovative features of countermatrix 218 as preferred in this third embodiment are described hereafter referring to the cited figures.

Countermatrix 218 is preferably produced by using casehardened and lapped steel and formed as a long body the cross sections of which have a rectangular outline. The operative side of such body is on a longitudinal plane p—p and is particularly shaped as explained hereafter. The opposite side thereof is formed in two sections, the first one, which is indicated with the reference numeral 240, being parallel to plane p—p and the second 242 being slightly inclined inwards, a middle arcuate connection 241 therebetween being provided as a supporting surface on the cylindrical member 224. The top and bottom edges 218' and 218" as they are seen in FIG. 14 correspond to the input and output edge, respectively, of the pipe to be held between such countermatrix 218 and matrix 213 when a bending operation is to be carried out.

The particularly shaped surface of countermatrix 218 comprises grooved sections suitable to co-operate with the semicircular groove 214 of matrix 213. In FIG. 15 it is in the first place possible to see that an actual difference is provided between the groove shapes at the opposite edges 218' and 218" of the countermatrix, as these edges have been illustrated in a specular position. On the other hand, the longitudinal section of FIG. 14 shows the course of the shaped surface of the countermatrix from such input edge 218' of the pipe to output edge 218" of same.

Figure 9:
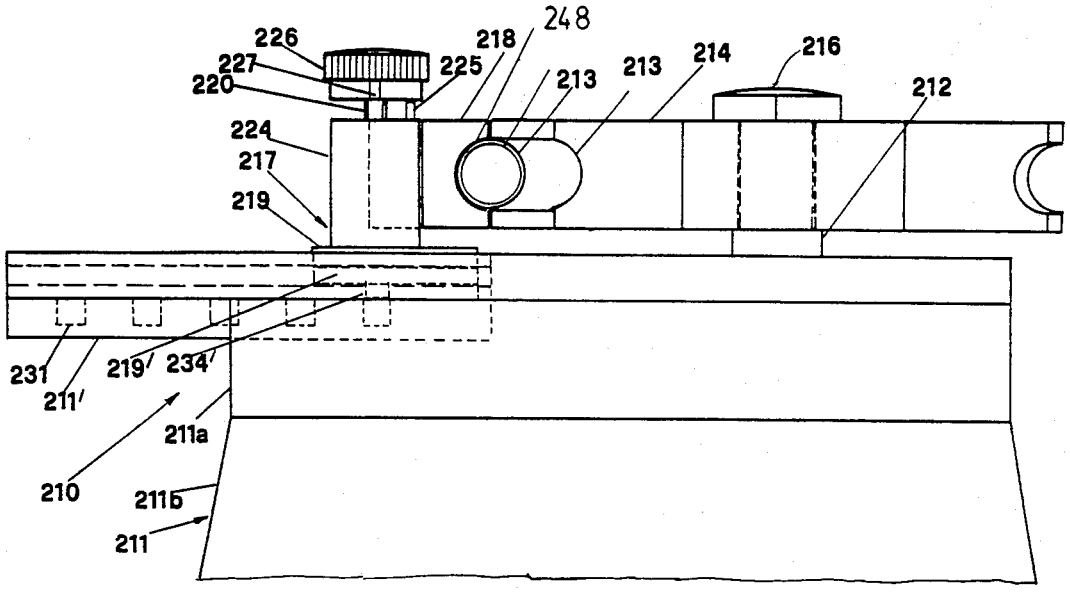
FIG. 9 is a schematic partially removed elevation view from the output side of the pipe to be bent, in accordance with FIG. 8.
Figure 10:
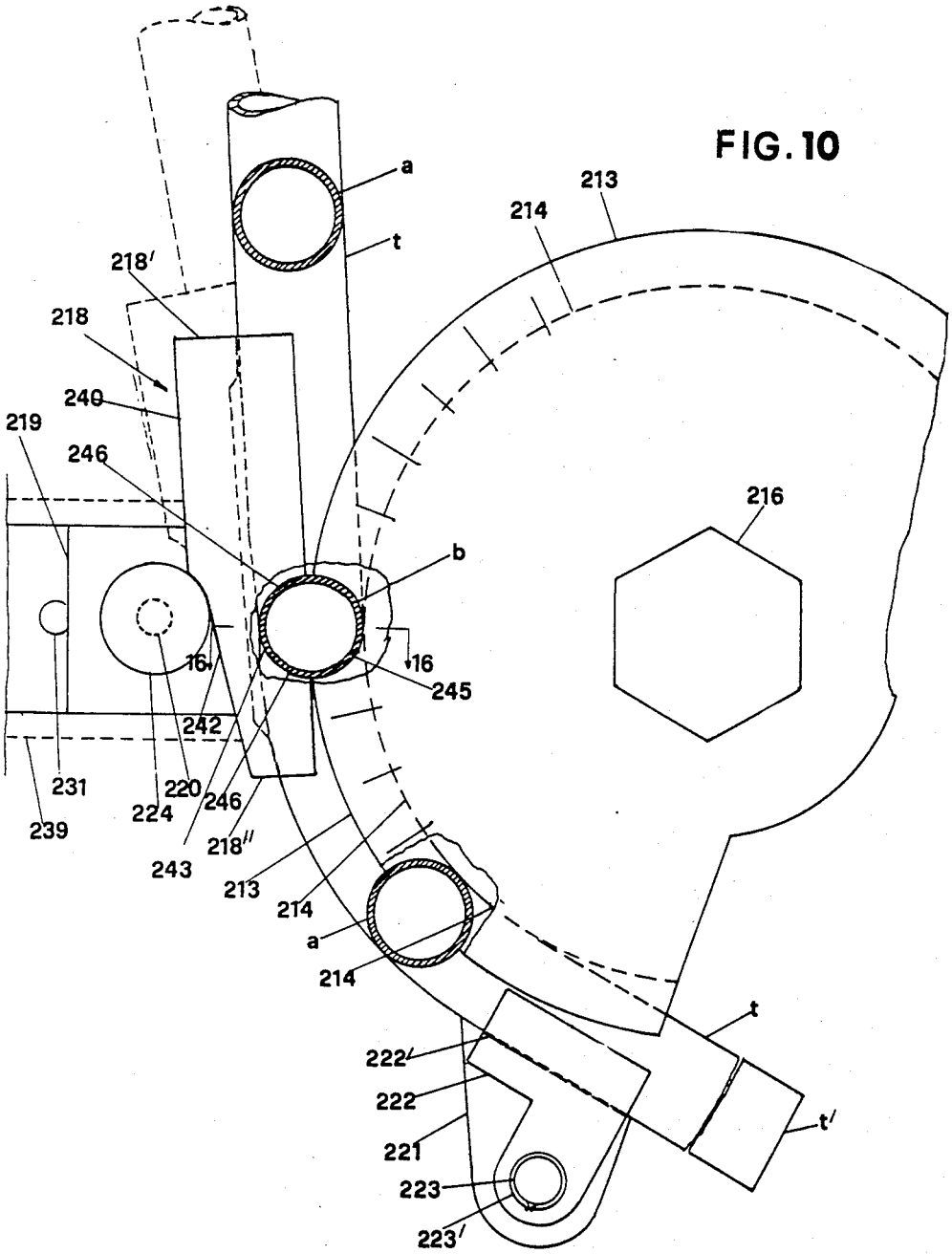
FIG. 10 is on a larger scale a schematic top view like FIG. 8, wherein the bending members and pipe are however shown after a partial or total bending of the pipe has been carried out.

A first shaped section 245 begins on the upper edge 218' with a cylindrical semicircular groove, the radius of which is indicated with the reference character y and is the radius of pipe t and groove 214 of matrix 213 (see FIGS. 8 to 10). From the opposite edge 218" begins the shaped section 246 with the original radius x on the middle longitudinal plane (corresponding to the diametral plane of pipe t to be bent), such radius x being smaller than radius y as may be seen particularly in FIG. 14. It is important to note that such radius x on the middle longitudinal plane is to be selected smaller than radius y for a desired pressure effect and consequent momentary elastic deformation of pipe t during the bending operation, namely when pipe t is advanced between the grooved section 246 of countermatrix and facing groove 214 of matrix 213, as shown in the detailed cross section of FIG. 16.

Because of the particularly shaped groove of countermatrix 218 and the consequent pressure effect on a pipe t, the original circular cross section a of the pipe (see FIG. 10) is deformed and a momentary oval shape b is thereby assumed as shown in FIGS. 10 and 16. This deformation is however an elastic deformation which provides a reserve of resistance of the pipe to the stretching stresses, so that the original circular cross section a is easily and quickly recovered after such pressure effect is ended.

Those skilled in the art may then easily understand that when a portable electrochemically-controlled pipe-bending apparatus is used in accordance with this third embodiment of the invention to bend a pipe also up to an angle of 180°, it is possible not only to bend a still wider range of pipe diameters—for example from about 4 mm to about 35 mm—without using any core for the bending operation even when the thickness of the pipe is very small, but also to achieve very satisfactory results. As established by many experiments of the inventors the uneveness of stretching in a bent pipe is effectively avoided and the bent pipe appears smooth again after the bending operation has been accomplished.

Moreover it should be pointed out that by reversing the rotating motion of matrix 213 after the bending operation has been accomplished, countermatrix 218 is easily released because of the reversed friction effect between the bending members and the bent pipe held therebetween. The bending operation of a next pipe may then be started and continued as described above.

It will be understood that the above described and illustrated embodiments of the present invention do not limit the possibility of further changes and modifications that those skilled in the art may select in accordance with the desired use of the apparatus of the invention and within the principles of the same.

What we claim is:

1. A portable electromechanically-controlled pipe-bending apparatus for bending up to an angle of 180° pipes of materials which are particularly sensitive to the stretching stresses provided during a bending operation, comprising:

a. a main body in the form of a substantially parallelepiped-box wherein a driving motor-reducer is contained, on the output shaft of which is fastened the main bending matrix of the apparatus in order to be rotated at a suitable slow rotating speed;

b. said main bending matrix being in the form of a semi-pulley having a peripheral semicircular groove, which is driven in rotation by said driving motor-reducer about a first axis;

c. a second bending countermatrix which is provided with a concave groove facing said peripheral semicircular groove of the matrix and adapted to cooperate with the same so that a pipe to be bent may be held and bent therebetween when said matrix is rotated for a bending operation, the operative shaped surface of said countermatrix (218) comprising a shaped section (245) which begins on an input edge (218') of the countermatrix and has a cylindrical semicircular groove with the same radius (y) as the pipe to be bent and as said groove (214) of said matrix (213), and a shaped section (246) which begins from an output edge (218'') of the countermatrix opposite from said input edge (218') with a shallower depth (x) and extends progressively up to the end of said section (246) wherein the radius (y) is again that of the pipe to be bent;

d. means to support said countermatrix for movement toward and away from said matrix so that said countermatrix can be set at the right distance from the matrix in accordance with the diameter of the pipe to be bent, said support means comprising a cylindrical support member (224), the operative side of said countermatrix lying on a longitudinal plane (p-p) which also comprises a longitudinal plane along the pipe to be bent, said countermatrix having, on its side opposite said operative side, a surface (242) that inclines away from said plane from said output edge (218'') toward said input edge (218'') and that terminates in a concave arcuate section (241) the radius of which is that of said cylindrical supporting member (224); and e. a pipe supporting member having a rectilinear concave groove which is connected with said matrix through a base plate and has the function of an auxiliary means freely rotating on said base plate about a second axis parallel to said first axis so as to co-operate with said matrix and said countermatrix during a bending operation;

all these grooved co-operating bending members being interchangeable in accordance with the diameter of the pipe to be bent.

2. A portable pipe-bending apparatus according to claim 1, wherein said driving motor-reducer comprises a motor of about 400 to 500 W which rotates at a speed of about 25,000 to 26,000 r.p.m., and a reduction gear to highly reduce the speed of its output shaft to about 5 to 7 r.p.m., a section (12) of this latter protruding from the cover of said box (11, 111, 211) of the apparatus to support said matrix (13, 113, 213) which is fastened thereabout to be rotated at said highly reduced speed.

3. A portable pipe-bending apparatus according to claim 1 wherein:

a. a box (211) is provided which comprises two superimposed sections (211*a*) and (211*b*) the four sides of this latter being gradually enlarged to form a larger bottom surface of said box (211), said box having a cover provided with a protruding section (211') having two opposite parallel grooves (239) and a set of holes (231) along the middle line therebetween, in a radial direction of said matrix (213);

b. a unit (217) is provided to support a particularly shaped countermatrix (218), such a unit comprising: a vertical cylindrical supporting member (224) of said countermatrix (218) and a base plate (219) solid with said cylindrical supporting member (224), the opposite parallel edges (219') of said base plate (219) having protrusions to be inserted into said grooves (239) to allow the slidable motion of said unit (217) therealong, said vertical cylindrical supporting member (224) of said countermatrix (218) being provided with a coaxial hole (224') which is enlarged at its lower section to form a shoulder, and a pin (234) movable within said coaxial hole (224'), a spiral pressure spring (236) mounted about pin (234) and between said shoulder and a flange (235) thereof, in order that said pin is usually pushed downwards and its bottom end (234') protrudes from the bottom surface of said base plate (219) to enter into one of said holes (231) to set said countermatrix (218) at the right distance from the facing matrix (213) of the apparatus, the top end (220) of said pin (234) being provided with a handle (236) fastened thereon which is operated to withdraw the bottom end (234') of said pin (234) from a said hole (231) when said unit (217) is to be slidable along said grooves (239); and c. an auxiliary pipe supporting member (222) which has a rectilinear concave groove and is freely rotatable about a pin (223) fastened to a base plate (221), this latter forming a single body with said matrix (213) from which it protrudes.

4. A portable pipe-bending apparatus according to claim 1 wherein the rotating motion of the matrix (214) may be reversed to release said countermatrix (218) when the bending operation is completed.

5. A portable pipe-bending apparatus according to claim 1 wherein said concave groove of said pipe supporting member is longer in the direction of the pipe than the diameter of the pipe.

6. A portable pipe-bending apparatus according to claim 1, wherein said countermatrix (218) comprises an independent elongated body to be manually interposed between said cylindrical supporting member (224) and a pipe to be bent.

* * * * *

UNITED STATES PATENT AND TRADEMARK OFFICE

CERTIFICATE OF CORRECTION

PATENT NO. : 4,532,787

DATED : August 6, 1985

INVENTOR(S) : Alessandro Caporusso, et al.

It is certified that error appears in the above-identified patent and that said Letters Patent is hereby corrected as shown below:

The sheet of drawing consisting of Fis. 11-16 should be deleted to appear as per attached sheet.

Signed and Sealed this

Twenty-seventh Day of August, 1991

*Attest:*

HARRY F. MANBECK, JR.

*Attesting Officer*

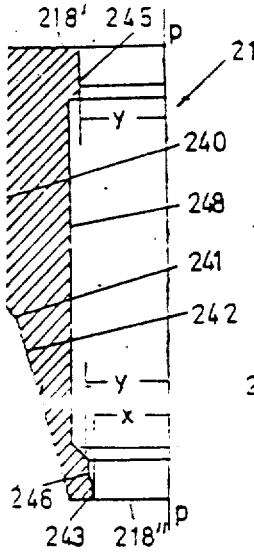
FIG.14
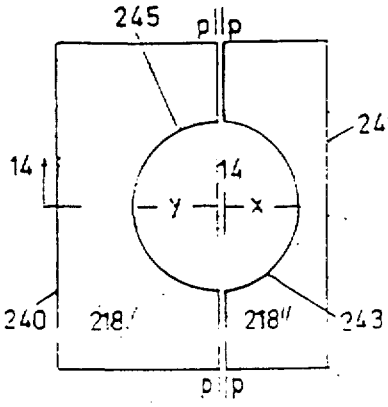
FIG.15
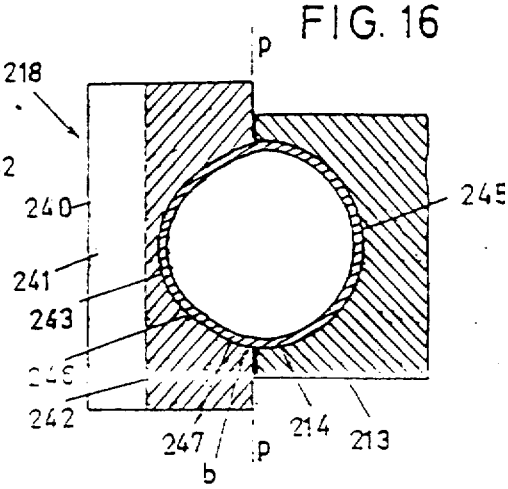
FIG. 16
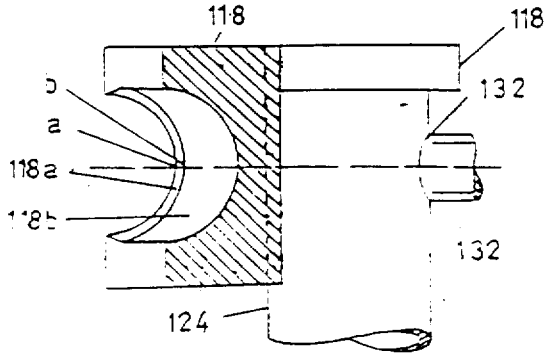
FIG.12
FIG.11
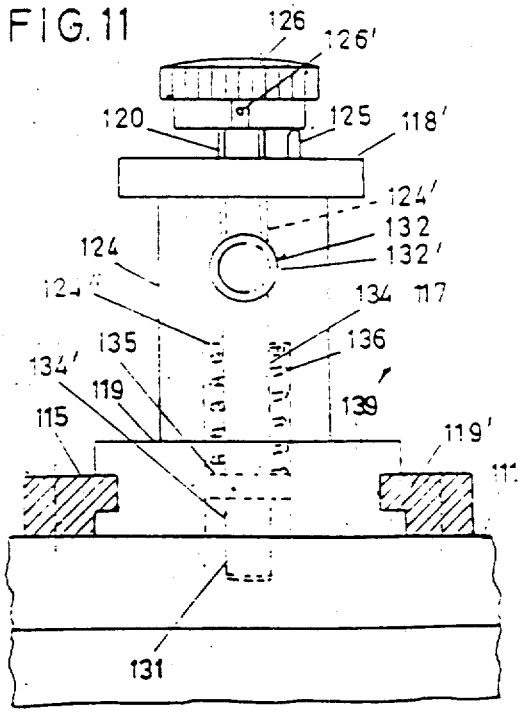
FIG.13
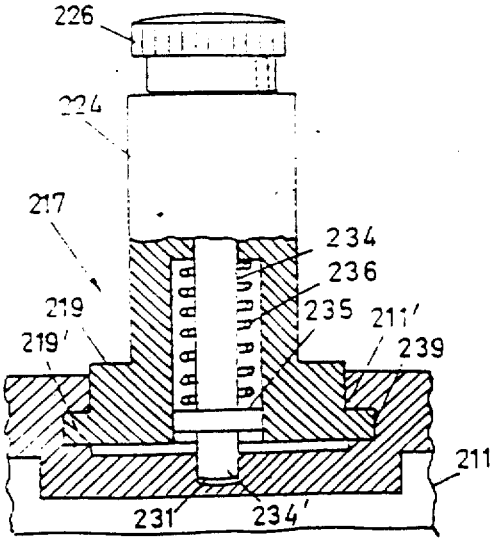

*Commissioner of Patents and Trademarks*